US010041382B2

(12) United States Patent
Tomoda et al.

(10) Patent No.: US 10,041,382 B2
(45) Date of Patent: Aug. 7, 2018

(54) VARIABLE VALVE APPARATUS FOR INTERNAL COMBUSTION ENGINE

(71) Applicant: TOYOTA JIDOSHA KABUSHIKI KAISHA, Toyota-shi, Aichi-ken (JP)

(72) Inventors: Keiju Tomoda, Susono (JP); Yoshiaki Miyazato, Susono (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 226 days.

(21) Appl. No.: 14/994,716

(22) Filed: Jan. 13, 2016

(65) Prior Publication Data

US 2016/0208661 A1 Jul. 21, 2016

(30) Foreign Application Priority Data

Jan. 15, 2015 (JP) ..... 2015-005754

(51) Int. Cl.

| | |
|---|---|
| ***F01L 1/34*** | (2006.01) |
| ***F01L 1/047*** | (2006.01) |
| ***F01L 1/053*** | (2006.01) |
| ***F01L 1/08*** | (2006.01) |
| *F01L 1/18* | (2006.01) |
| *F01L 1/24* | (2006.01) |

(52) U.S. Cl.

CPC ..... *F01L 1/047* (2013.01); *F01L 1/053* (2013.01); *F01L 1/08* (2013.01); *F01L 1/185* (2013.01); *F01L 1/2405* (2013.01); *F01L 2001/0473* (2013.01); *F01L 2105/00* (2013.01)

(58) Field of Classification Search

CPC ... F01L 13/0063; F01L 13/0021; F01L 1/053; F01L 1/08; F01L 1/047; F01L 1/185; F01L 1/2405; F01L 2105/00; F01L 2001/0473

See application file for complete search history.

(56) References Cited

U.S. PATENT DOCUMENTS

| | | | |
|---|---|---|---|
| 6,427,653 | B1 | 8/2002 | Hara et al. |
| 2015/0184560 | A1 | 7/2015 | Yano et al. |

FOREIGN PATENT DOCUMENTS

| | | | |
|---|---|---|---|
| DE | 10053776 | A1 | 7/2001 |
| DE | 102009022642 | A1 | 12/2010 |
| GB | 2385888 | A | 9/2003 |
| JP | 2001329819 | A | 11/2001 |
| JP | 2008-095568 | A | 4/2008 |
| WO | 2014/030226 | A1 | 2/2014 |

*Primary Examiner* — Zelalem Eshete

(74) *Attorney, Agent, or Firm* — Hunton Andrews Kurth LLP

(57) ABSTRACT

An variable valve apparatus for an internal combustion engine according to the invention includes a cam base member, an elastic member, a cam lobe member, and a mechanism for fixing the cam lobe member to the cam base member. The cam lobe member includes a main cam part, and a push part provided at a different position from this. The cam lobe member can move relative to the cam base member, between a first position at which the push part protrudes from the cam base member and a second position at which the main cam part protrudes from the cam base member. The cam lobe member is biased toward the first position by the elastic member. When the push part is pushed by a follower member linked to an engine valve, the cam lobe member can move toward the second position side.

9 Claims, 19 Drawing Sheets

VARIABLE VALVE APPARATUS FOR INTERNAL COMBUSTION ENGINE

INCORPORATION BY REFERENCE

The disclosure of Japanese Patent Application No. 2015-005754 filed on Jan. 15, 2015 including the specification, drawings and abstract is incorporated herein by reference in its entirety.

BACKGROUND OF THE INVENTION

1. Field of the Invention

The invention relates to a variable valve apparatus for an internal combustion engine.

2. Description of Related Art

Conventionally, there is known a mechanism or an apparatus that can vary the lift amount of an engine valve. International Publication No. 2014/030226 discloses an example of an apparatus that can vary the protrusion amount of a cam on a camshaft. The apparatus includes a cam base member to perform rotary drive by the drive force from a crankshaft, and a cam lobe member linked to the cam base member so as to be capable of oscillating. Depending on the actuation state of a hydraulic system, the cam lobe member is selectively positioned at either of a storage position at which the cam lobe member is stored in the cam base member and a protrusion position at which the cam lobe member protrudes from the cam base member outward in a radial direction. Thereby, the apparatus in International Publication No. 2014/030226 can vary the lift amount of the engine valve.

SUMMARY OF THE INVENTION

Here, the motion of a cam lobe member 102 relative to a cam base member 104 in the apparatus in International Publication No. 2014/030226 will be described based on FIG. 1A and FIG. 1B. FIG. 1A shows an example of the state in which the cam lobe member 102 is at the protrusion position, and FIG. 1B shows an example of the state in which the cam lobe member 102 is at the storage position. The cam lobe member 102, at all times, is biased toward the protrusion position by a spring (not illustrated). For restricting the protrusion amount (that is, the oscillation range) of the cam lobe member 102 due to the bias by the spring, a stopper pin 106 fixed to the cam lobe member 102 is disposed in a guide groove (long hole) 108 of the cam base member 104 so as to be capable of moving along the longitudinal direction.

When the cam lobe member 102 is fixed at the protrusion position relative to the cam base member 104 because hydraulic pressure is not applied, the cam lobe member 102 pushes a rocker arm, and thereby, it is possible to open a valve (see the solid line in FIG. 2A). On the other hand, when the cam lobe member 102 is fixed at the storage position relative to the cam base member 104 because the hydraulic pressure is applied, the valve is not particularly forced in the opening direction (see the dotted line in FIG. 2A). This is because the outer surface of the cam base member 104 in FIG. 1B has a shape based on the reference circle. When the position of the cam base member is changed from the protrusion position to the storage position, the hydraulic pressure is applied. To the contrary, when the position of the cam lobe member is changed from the storage position to the protrusion position, the hydraulic pressure is released.

When the hydraulic pressure is released, the cam lobe member continues to oscillate relative to the cam base member, as long as the cam lobe member is not in a fixation state. FIG. 2B conceptually shows the motion of the stopper pin 106 (that is, the motion of the cam lobe member) when the camshaft rotates in a state in which the cam lobe member is not fixed. The graph of FIG. 2B shows the motion of the stopper pin as the lost angle. As shown in FIG. 1B, a lost angle $\alpha$ corresponds to a rotation angle of the stopper pin 106 around the oscillation center (the center of a fulcrum member 110) of the cam lobe member 102 relative to the cam base member 104. The lost angle $\alpha$, here, is defined so as to be zero when the cam lobe member 102 is at the protrusion position as shown in FIG. 1A, and to increase as the position of the cam lobe member 102 becomes close to the storage position.

As shown schematically in FIG. 2B, when the cam lobe member 102 is not fixed by a lock pin, it is desirable that the lost angle change in a manner shown by the solid line. However, if the bias force of the spring is insufficient, a sharp motion of the cam lobe member 102 right before the cam lobe member 102 reaches the protrusion position, that is, in the final stage of the oscillation cannot be sometimes actualized by the bias force of the spring. In this case, the contact between the cam lobe member and the rocker arm is once broken, and thereafter, the cam lobe member reaches the protrusion position. Thereby, the stopper pin 106 collides with one end part of the guide groove 108 in the longitudinal direction, at a rate that is greater than an originally provided ramp rate (see the dotted line in FIG. 1B). Such a collision between the members produces collision sound when the internal combustion engine operates at a low revolution (for example, at the time of idle operation), and therefore, an improvement is demanded.

Hence, the invention provides a variable valve apparatus for an internal combustion engine that makes it possible to inhibit a drastic motion of the cam lobe member relative to the cam base member.

A variable valve apparatus for an internal combustion engine in an aspect of the invention is a variable valve apparatus that is capable of varying lift amount of an engine valve, the variable valve apparatus including: a cam base member provided on a camshaft, the cam base member being configured to rotate in accordance with rotation of the camshaft; a cam lobe member provided so as to be movable relative to the cam base member, the cam lobe member including a main cam part and a push part, the push part being at a different position from the main cam part; an elastic member provided between the cam base member and the cam lobe member; and a fixation mechanism configured to fix the cam lobe member to the cam base member, the cam lobe member being configured such that (a) the cam lobe member is movable relative to the cam base member between a first position and a second position, (b) the push part of the cam lobe member is in a state of protruding relative to the cam base member and the main cam part is in a state of not protruding relative to the cam base member, when the cam lobe member is at the first position, (c) the push part is in a state of not protruding relative to the cam base member and the main cam part is in a state of protruding relative to the cam base member, when the cam lobe member is at the second position, (d) the cam lobe member is configured to move from the first position side toward the second position side, when the cam lobe member is biased toward the first position by the elastic member and the push part is pushed by the engine valve or a follower member linked to the engine valve, and (e) the cam lobe member is configured to be fixed to the cam base member by the fixation mechanism, when the cam lobe member is at the second position.

The variable valve apparatus may further include a restriction mechanism for restricting a movement range of the cam lobe member relative to the cam base member.

The cam lobe member may be configured to move around a fulcrum member relative to the cam base member. The fulcrum member may be provided at any one of two connection parts that connect the main cam part and the push part of the cam lobe member and that are apart in a circumferential direction. The push part of the cam lobe member may include a concave curve part on the fulcrum member side, and a convex curve part apart from the concave curve part. When an outer circumferential surface of the cam base member has a shape of a reference base circle, the fulcrum member may be disposed at a connection part that is of the two connection parts and that is on a closing side of the main cam part of the cam lobe member. In the case where a first lift curve of the engine valve when the cam lobe member is not fixed at the second position and a second lift curve of the engine valve when the cam lobe member is fixed at the second position overlap on a closing side or an opening side, the arrangement position of the fulcrum member may be set to one connection part that is of the two connection parts and that makes an oscillation angle of the cam lobe member around the fulcrum member between the first position and the second position relatively smaller.

Alternatively, the variable valve apparatus may be configured such that the cam lobe member performs reciprocating motion linearly relative to the cam base member. In this case, the push part of the cam lobe member may be formed so as to have reflective symmetry on a surface that is orthogonal to an axis direction of the camshaft.

The invention relates also to an internal combustion engine including the above variable valve apparatus for the internal combustion engine.

According to the above aspect of the invention, the cam lobe member provided relative to the cam base member includes the main cam part and the push part provided at a different position from the main cam part, and is biased toward the first position by the elastic member. The push part is pushed by the engine valve or the follower member, and thereby, the cam lobe member can move from the first position side toward the second position side. Therefore, it is possible to move the cam lobe member to the second position, by pressing the push part provided at a different position from the main cam part against the bias force of the elastic member, and furthermore, it is possible to return the cam lobe member to the first position by the bias force of the elastic member. Since the push part is provided at a different spot from the main cam part, the flexibility of the design is high. Therefore, according to the aspect of the invention, by the optimization of the shape of the push part, an excellent effect is exerted in that it is possible to inhibit a drastic motion of the cam lobe member relative to the cam base member.

BRIEF DESCRIPTION OF THE DRAWINGS

Features, advantages, and technical and industrial significance of exemplary embodiments of the invention will be described below with reference to the accompanying drawings, in which like numerals denote like elements, and wherein:

FIG. 1A and FIG. 1B are diagrams showing a related variable valve apparatus, in which FIG. 1A shows a state in which a cam lobe member is at a protrusion position and FIG. 1B shows a state in which the cam lobe member is at a storage position;

FIG. 5A and FIG. 5B are diagrams for describing a motion of a cam lobe member of the variable valve apparatus in FIG. 3, in which FIG. 5A shows a state in which the cam lobe member is at a second position and FIG. 5B shows a state in which the cam lobe member is at a first position;

FIG. 10A and FIG. 10B are diagrams for describing a modification of the cam unit, in which FIG. 10A shows a configuration according to the first embodiment for comparison and FIG. 10B shows a configuration of the modification;

FIG. 13A to FIG. 13D are each schematic views showing a further modification of the fixation mechanism in FIG. 7A to FIG. 7C, in which FIG. 13A and FIG. 13B show a state in which the cam lobe member is fixed at the second position and FIG. 13C and FIG. 13D show a state in which the cam lobe member is fixed at the first position;

FIG. 14A to FIG. 14C are diagrams related to an internal combustion engine to which a variable valve apparatus for an internal combustion engine according to a second embodiment of the invention is applied, in which FIG. 14A shows lift curves of inlet and exhaust valves, FIG. 14B relates to a cam unit for the exhaust valve and FIG. 14C relates to a cam unit for the inlet valve;

FIG. 15A and FIG. 15B are diagrams for describing a configuration of the cam unit for the exhaust valve in the second embodiment, in which FIG. 15A shows a state in which the cam lobe member is at the second position and FIG. 15B shows a state in which the cam lobe member is at the first position;

FIG. 16A and FIG. 16B are diagrams for describing a configuration of the cam unit for the inlet valve in the second embodiment, in which FIG. 16A shows a state in which the cam lobe member is at the second position and FIG. 16B shows a state in which the cam lobe member is at the first position;

FIG. 17A and FIG. 17B are diagrams for describing a modification of the cam unit for the exhaust valve in FIG. 15A and FIG. 15B, in which FIG. 17A shows a state in which the cam lobe member is at the second position and FIG. 17B shows a state in which the cam lobe member is at the first position;

FIG. 18A and FIG. 18B are diagrams for describing a modification of the cam unit for the inlet valve in FIG. 16A and FIG. 16B, in which FIG. 18A shows a state in which the cam lobe member is at the second position and FIG. 18B shows a state in which the cam lobe member is at the first position; and FIG. 19A and FIG. 19B are diagrams showing a principal part of a variable valve apparatus for an internal combustion engine according to a third embodiment of the invention, in which FIG. 19A shows a state in which the cam lobe member is at the second position and FIG. 19B shows a state in which the cam lobe member is at the first position.

DETAILED DESCRIPTION OF EMBODIMENTS

Hereinafter, embodiments of the invention will be described based on the accompanying drawings.

Figure 3:
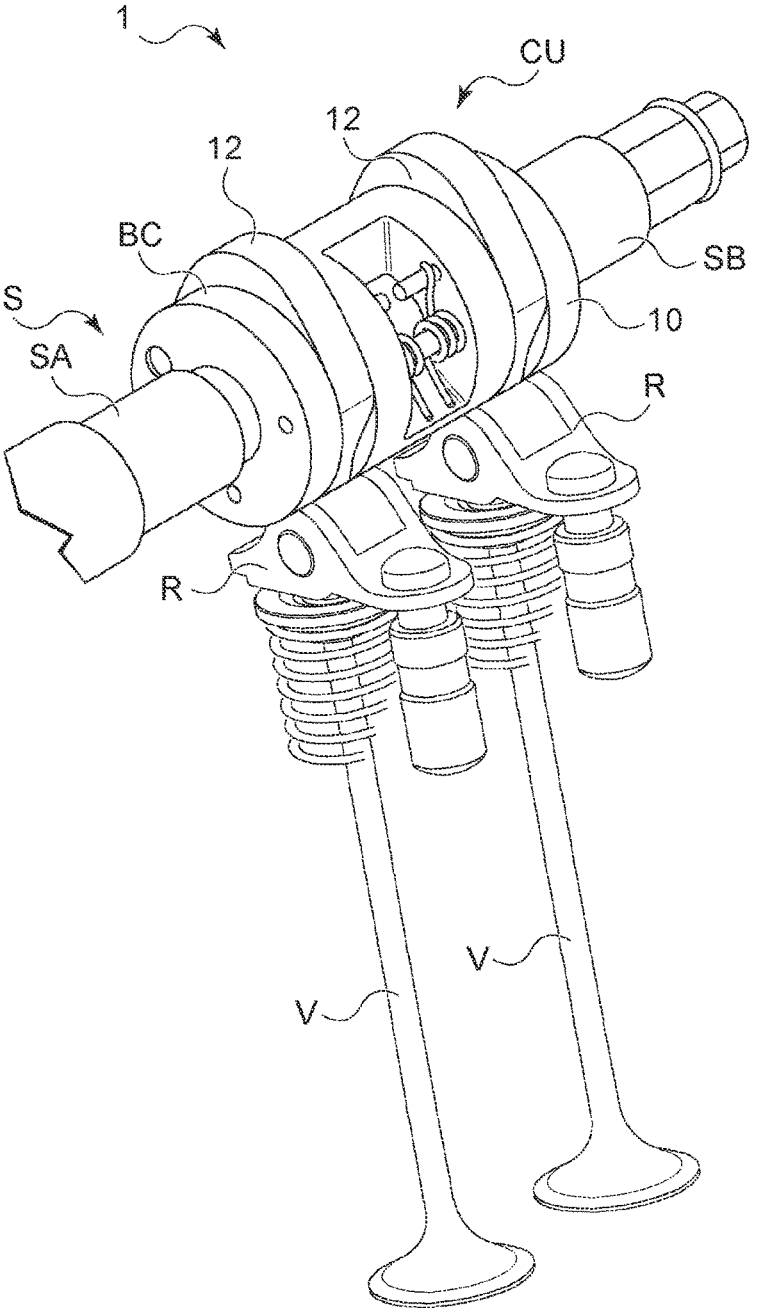
FIG. 3 is a diagram showing a principal part of a variable valve apparatus for an internal combustion engine according to a first embodiment of the invention.
Figure 4:
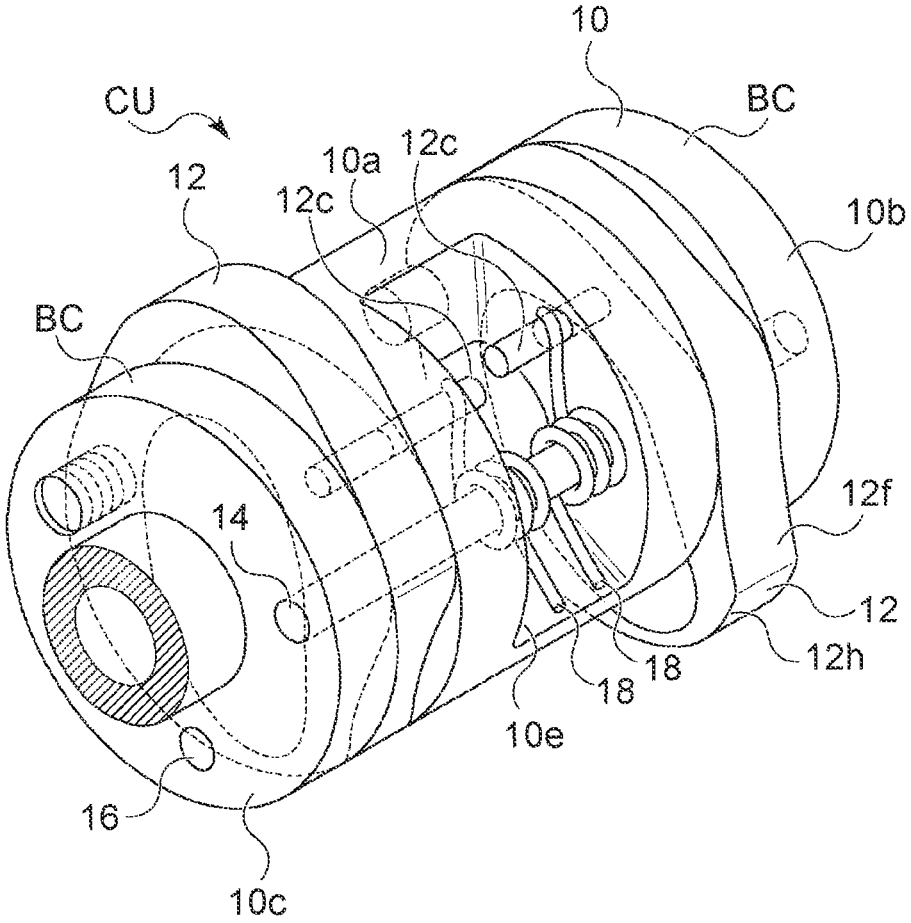
FIG. 4 is an enlarged view of a cam unit of the variable valve apparatus in FIG. 3, and is a diagram showing two cam lobe members that are at different positions.

FIG. 3 is an external view of a variable valve apparatus 1 for an internal combustion engine according to a first embodiment, and FIG. 4 is an enlarged view of a cam unit thereof. The variable valve apparatus 1 is applied to an internal combustion engine that is mounted in a vehicle. The internal combustion engine is a four-cylinder engine, but in the invention, the cylinder number, cylinder array, combustion type and others of the internal combustion engine to be applied do not matter. Further, the internal combustion engine to which the invention is applied may be used in other than a vehicle.

The variable valve apparatus 1 includes a camshaft S, and on the camshaft S, a cam unit CU is provided. The camshaft S includes a part SA connected with one end of the cam unit CU, and a part SB connected with the other end of the cam unit CU. The camshaft S is rotated by the dynamic power from the internal combustion engine. More specifically, the camshaft S is driven so as to be rotated, by the drive force from a crankshaft. The cam unit CU is rotated together with the camshaft S, and thereby, it is possible to lift engine valves V through rocker arms R. Here, the valves V are inlet valves of the internal combustion engine, but may be exhaust valves.

The cam unit CU, which is greater in diameter than the parts SA, SB of the camshaft S, includes a cam base member 10 linked to the parts SA, SB of the camshaft S and two cam lobe members 12 linked to the cam base member 10 so as to be movable. The cam base member 10 has a nearly circular cylinder shape, and includes base circle parts BC (shape parts corresponding to a reference base circle) having a nearly circular shape when viewed from an axis direction of the camshaft S (hereinafter, referred to as merely an "axis direction"). The base circle parts BC correspond to the outer circumferential surface of the cam base member 10. The two cam lobe members 12 are configured to lift the two valves V (that is, to move the two valves V for valve opening) by pushing the two rocker arms R, respectively. The thickness of the cam base member 10 in the axis direction is greater than the thickness of the cam lobe member 12 in the axis direction.

The cam base member 10 herein, which can be mainly divided into three, includes a central body part 10*a* positioned at the center in the axis direction, and two end body parts 10*b*, 10*c* at both sides of the central body part 10*a* in the axis direction. The cam lobe members 12 are disposed at both end parts of the central body part 10*a*, respectively, and in this state, the end body parts 10*b*, 10*c* are connected. Across all of the three parts 10*a*, 10*b*, 10*c* of the cam base member 10, an inner axis part 10*d* is provided along an axis line in the axis direction. In the inner axis part 10*d*, an oil passage is formed along the axis line. The cam lobe member 12, which has a flat plate shape, is configured as a toroidal member, and is attached to the cam base member 10 in a state in which the axis part 10*d* is inserted into a hole 12*b* at the center of a body part 12*a* of the cam lobe member 12. Here, FIGS. 3 and 4 illustrate two shaft members for linking the three parts 10*a*, 10*b*, 10*c* of the cam base member 10 to each other. One of the two shaft members is a support shaft 14 described later, and the other is a fixation shaft 16. The cam lobe member 12 will be described later in detail.

As shown in FIGS. 3 and 4, the central body part 10*a* of the cam base member 10 includes a concave part 10*e* that is positioned between the two cam lobe members 12. The concave part 10*e* is formed between parts where the two rocker arms R contact with the cam base member 10 (for example, between the base circle parts BC). Therefore, the concave part 10*e* does not contact with the rocker arms R. The support shaft 14 is disposed so as to penetrate through respective sidewall parts of the concave part 10*e* that are apart in the axis direction. The support shaft 14 penetrates through the cam base member 10 and the cam lobe members 12 in the axis direction of the camshaft S, and links them to each other.

The cam lobe member 12 is disposed on the cam base member 10 such that the cam lobe member 12 can perform reciprocating motion (particularly oscillate, herein) in a predetermined range relative to the cam base member 10, while adopting the support shaft 14 as a fulcrum member. On each of the two cam lobe members 12, a stopper pin 12*c* is fixed so as to protrude from the body part 12*a*, which has a nearly toroidal shape, in the axis direction of the camshaft S. The stopper pins 12*c* reach the concave part 10*e* through elongated through-holes 10*s* of the central body part 10*a* of the cam base member 10. The stopper pins 12*c* and the through-holes 10*s* constitute a restriction mechanism of the cam lobe member 12.

In the concave part 10*e* of the cam base member 10, two springs 18 are attached to the support shaft 14. Each spring 18 is attached to the corresponding cam lobe member 12, and is provided such that the cam lobe member 12 is biased in a predetermined direction (hereinafter, referred to as a bias direction) around the support shaft 14. Here, the spring 18 is attached around the support shaft 14. One end of the spring 18 presses the concave part 10*e* of the cam base member 10, and the other end of the spring 18 presses the stopper pin 12*c*. Here, in FIG. 4, the cam lobe member 12 on the right side and the cam lobe member 12 on the left side are described so as to be in different states (the member 12 on the right side is at a "first position" and the member 12 on the left side is at a "second position"). However, this is shown merely for purpose of explanation, in order to facilitate the understanding of the disposition of the cam lobe members 12 relative to the cam base member 10. Actually, for example, as shown in FIG. 3, the two cam lobe members 12 are in the same state, relative to the one cam base member 10.

Figure 5A:
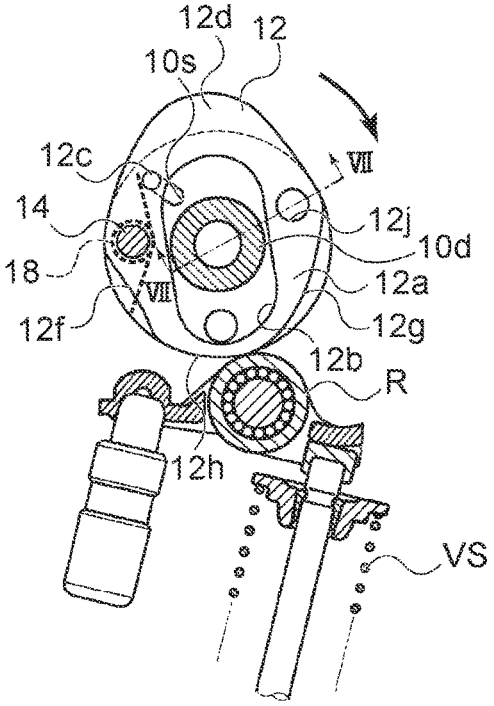
Figure 5B:
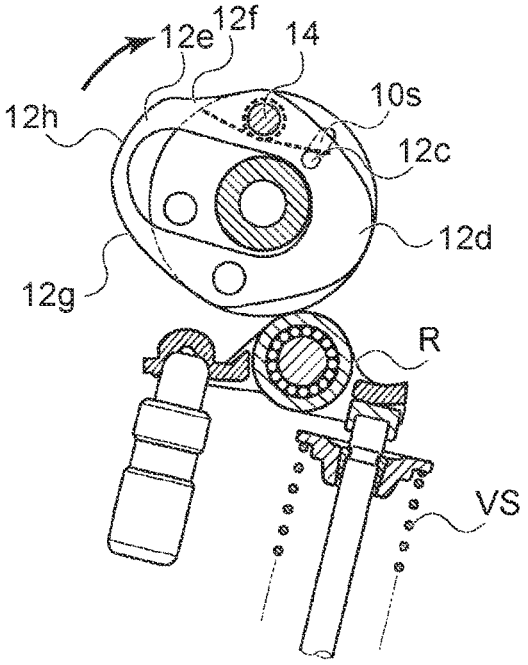

Here, the shape and configuration of the cam lobe member 12 will be described with reference to FIG. 5A and FIG. 5B. FIG. 5A and FIG. 5B are schematic views of one of the cam lobe members 12 as viewed from the axis direction of the camshaft S (from the back side in FIG. 3). FIG. 5A shows an example of the case where the cam lobe member 12 is at a position (second position) when the cam lobe member 12 is pushed most in a push direction (opposite to the bias direction) by the rocker arm R. FIG. 5B shows an example of the case where the cam lobe member 12 is at a position (first position) when the cam lobe member 12 is pushed most in the bias direction by the bias force of the spring 18.

The cam lobe member 12 is configured as a plate-shaped member that is independent of the cam base member 10, and further, has a toroidal shape. Here, in the body part 12*a* of the cam lobe member 12, two facing surfaces disposed so as to be oriented in the axis direction of the cam unit CU are referred to as end surfaces, and a surface extending between the end surfaces is referred to as a circumferential side surface. The hole 12*b* of the cam lobe member 12 extends so as to penetrate through the two end surfaces of the body part 12*a*, and the circumferential side surface extends parallel to the axis direction. The inner axis part 10*d* of the cam base member 10 is inserted into the hole 12*b* of the cam lobe member 12. In the hole 12*b*, the inner axis part 10*d* can move relative to the cam lobe member 12 (see FIG. 5A and FIG. 5B).

Furthermore, the cam lobe member 12 includes two parts that are integrally formed such that the hole 12*b* is formed between them. The cam lobe member 12 includes a main cam part 12*d* and a push part 12*e* formed at a position that is different from the main cam part 12*d* (particularly, at a position that is apart in a circumferential direction of the cam lobe member 12). The main cam part 12*d* is configured for driving the rocker arm R. Particularly, when the lift amount of the valve V by the base circle part BC of the cam base member 10 is defined as a first lift amount herein, the main cam part 12*d* is formed into a shape suitable for actualizing a second lift amount that is greater than the first lift amount. Here, in the first embodiment, the first lift amount is zero. The push part 12*e* is a part that is subjected to the pushing force from the rocker arm R for oscillating the cam lobe member 12 when the cam lobe member 12 is not fixed to the cam base member 10 (for example, when the cam lobe member 12 is at the first position). Here, the variable valve apparatus 1 is configured such that the rocker arm R, which is a follower member linked to the valve V, acts on the push part 12*e*. However, a configuration in which another member, for example, the valve itself acts on the push part 12*e* is not excluded.

The cam lobe member 12 can be fixed to the cam base member 10 so as to be releasable, by a fixation member described later. When the cam lobe member 12 is at the first position (see FIG. 5B), the main cam part 12*d* of the cam lobe member 12 does not protrude from the cam base member 10 outward in a radial direction, along a virtual plane orthogonal to the axis direction of the camshaft, but the push part 12*e* protrudes from the cam base member 10 outward in a radial direction. On the other hand, when the cam lobe member 12 is at the second position (see FIG. 5A), the main cam part 12*d* protrudes from the cam base member 10 outward in a radial direction, but the push part 12*e* does not protrude from the cam base member 10. In this way, when the cam lobe member is at the second position, the main cam part 12*d* of the cam lobe member is in a state of protruding relative to the cam base member 10 outward in the radial direction, and when the cam lobe member is at the first position, the main cam part 12*d* is in a state of not protruding relative to the cam base member 10 outward in the radial direction, that is, in a non-protrusion state. To the contrary, when the cam lobe member is at the first position, the push part 12*e* of the cam lobe member is in a state of protruding relative to the cam base member 10 outward in the radial direction, and when the cam lobe member is at the second position, the push part 12*e* is in a state of not protruding relative to the cam base member 10 outward in the radial direction, that is, in a non-protrusion state. Particularly, the cam lobe member is disposed between the central body part and the end body part as described above, and therefore, when the main cam part 12*d* of the cam lobe member is in the non-protrusion state, the main cam part 12*d* is in a state of being stored (or contained) in the cam base member 10. Hence, based on the state of the main cam part 12*d* of the cam lobe member, the above first position can be referred to as the storage position, and the above second position can be referred to as the protrusion position.

The above-described restriction mechanism is provided such that the range in which the cam lobe member 12 can perform the reciprocating motion (that is, can oscillate) relative to the cam base member 10 is set to a region between the first position and the second position. Then, the fixation mechanism can fix the cam lobe member 12 at the second position relative to the cam base member 10, and the fixation state can be referred to as the lift state. Here, it is not always necessary to provide the above restriction mechanism, if the movable range of the cam lobe member 12 is restricted to a predetermined range by another structure or shape.

Figure 1A:
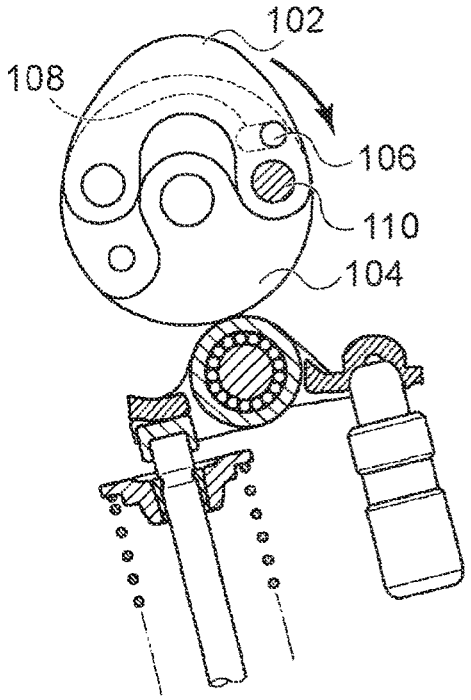
FIG. 1A RELATED ART
Figure 1B:
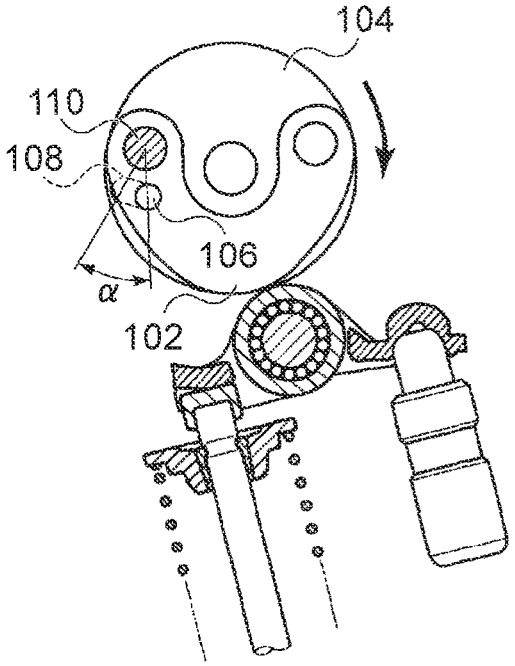
FIG. 1B RELATED ART
Figure 2A:
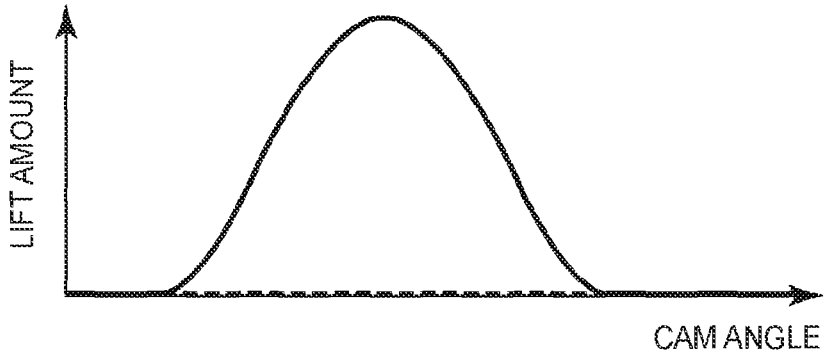
FIG. 2A RELATED ART
FIG. 2A is a graph showing a lift curve of the related variable valve apparatus.

In the lift state, the main cam part 12*d* can lift the valve so as to make the lift curve shown by the solid line in FIG. 2A, and has an outer shape therefor. On this occasion, the maximum lift amount is the above second lift amount.

The push part 12*e* is formed such that the cam lobe member 12 can smoothly oscillate around the support shaft 14. The push part 12*e* includes a (fulcrum side) concave curve part 12*f*, a convex curve part 12*g*, and a transition part 12*h* extending between them. The concave curve part 12*f*, the transition part 12*h* and the convex curve part 12*g* are disposed so as to be arrayed along the circumferential direction of the circumferential side surface of the cam lobe member 12. Therefore, the concave curve part 12*f* is apart from the convex curve part 12*g* in the circumferential direction of the cam lobe member 12. The transition part 12*h* connects the concave curve part 12*f* and the convex curve part 12*g*, and has a shape fitted to the base circle part BC. As understood from FIG. 5A and FIG. 5B, the support shaft 14 (as the fulcrum member) is positioned at the connection part between the main cam part 12*d* and the push part 12*e*. The concave curve part 12*f* is close to the support shaft 14, compared to the convex curve part 12*g*. In the example illustrated here, the concave curve part 12*f* is positioned on the forward side in the rotation direction (see the arrows in FIG. 5A and FIG. 5B) of the transition part 12*h*, and the convex curve part 12*g* is positioned on the backward side in the rotation direction of the transition part 12*h*. Therefore, the rocker arm R pushes the cam lobe member 12 along the concave curve part 12*f* of the push part 12*e*, and thereby, the cam lobe member 12 moves (toward the second position) such that the main cam part 12*d* protrudes from the cam base member 10 outward in the radial direction. On the other hand, the rocker arm R continues to push the cam lobe member 12 along the convex curve part 12*g* of the push part 12*e*, and thereby, the cam lobe member 12 moves (toward the first position) such that the main cam part 12*d* is stored in the cam base member 10.

The reciprocating motion of the cam lobe member 12 in the predetermined range relative to the cam base member 10 is shown in FIG. 6A to FIG. 6H. Here, in FIG. 6A to FIG. 6H, the spring 18 and the like are omitted. By the rotation of the camshaft S, FIG. 6A to FIG. 6H are repeated in order.

Figure 7A:
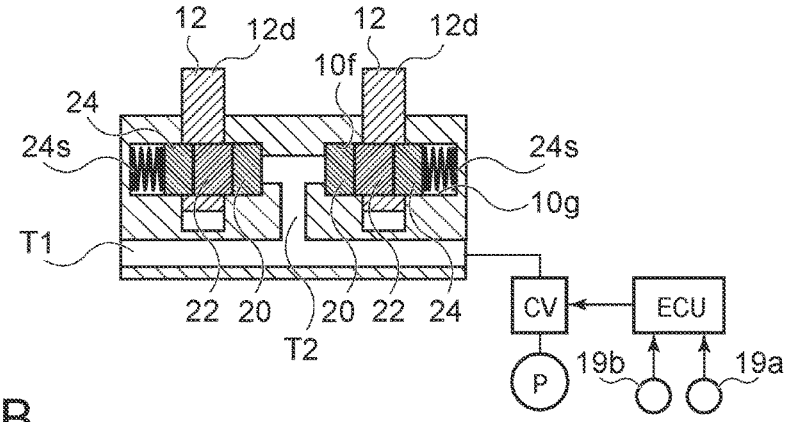
FIG. 7A to FIG. 7C are each schematic views for describing a fixation mechanism that fixes the cam lobe member of the variable valve apparatus in FIG. 3.
Figure 7B:
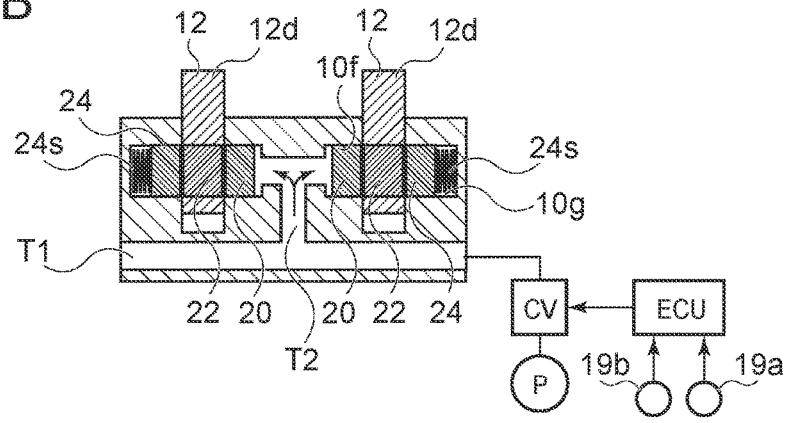
Figure 7C:
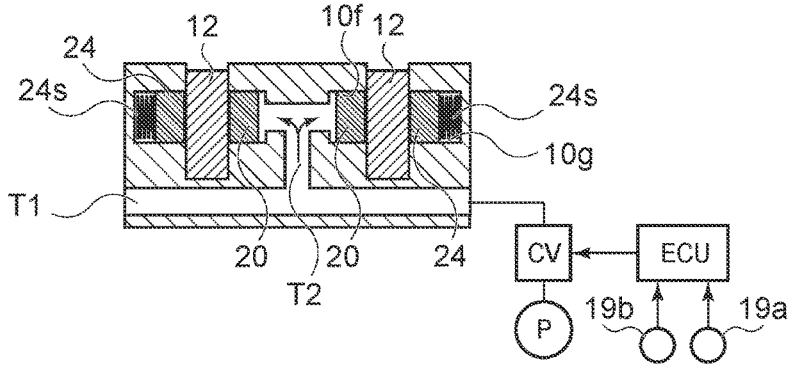

Here, the fixation mechanism for fixing the cam lobe member 12 to the cam base member 10 will be described with reference to FIG. 7A to FIG. 7C. FIG. 7A to FIG. 7C are cross-sectional schematic views showing an internal structure of the cam unit CU at a spot along line VII-VII in FIG. 5A. In FIG. 7A, the two cam lobe members 12 are in the state of being fixed at the second positions. As understood from FIG. 5A, it is unclear that the cam lobe members 12 actually protrude in the radial direction on this cross section. However, for facilitating the understanding, FIG. 7A and FIG. 7B show the cam lobe members 12 such that the main cam parts 12*d* protrude. Further, the cam unit CU is formed symmetrically in the axis direction.

The inner axis part 10*d* of the cam base member 10 extends in the axis direction, and an oil passage T1 is formed along the axis line. The oil passage T1 in the axis direction is connected with a radial-directional oil passage T2 that extends from the axis direction outward in the radial direction. The radial-directional oil passage T2 further branches and extends to the cam lobe member 12 sides in the axis direction.

On the upstream side of the oil passage T1, an oil control valve CV that can be controlled by an electronic control unit (ECU) as a control apparatus is provided. When the oil control valve CV is opened, the oil fed from a non-illustrated oil pan by an oil pump P can flow through the feed oil passage T1. The oil pump P is a mechanical pump that is interlocked with the crankshaft of the internal combustion engine, but may be an electric pump.

The ECU is substantially configured by a computer including an arithmetic processing device (for example, a CPU), a storage device (for example, a ROM and a RAM), an A/D converter, an input interface, an output interface and the like. With the input interface, various sensors are electrically connected. Based on signals from the various sensors, the ECU electrically outputs actuation signals or drive signals from the output interface such that the operation or actuation of the internal combustion engine is smoothly performed in accordance with a previously set program or the like. Thus, in addition to the actuation of a non-illustrated fuel injection valve and the like, the ECU controls the oil control valve CV. Here, some of the sensors will be specifically described. An engine speed sensor 19*a* for detecting the engine speed is provided. Further, an engine load sensor 19*b* for detecting the engine load is provided. Here, a throttle position sensor, an accelerator position sensor, an air flow meter, an intake pressure sensor and the like can be used as the engine load sensor 19*b*.

The cam unit CU includes a plurality of pins that act on the cam lobe member 12. Here, three pins 20, 22, 24 are used for fixing one of the cam lobe members 12. The three pins 20, 22, 24 are disposed in series, and are disposed in this order from the side close to the radial-directional oil passage T2. The inmost pin 24 is biased to the side of the radial-directional oil passage T2 by a spring 24*s*. By the bias force of the spring 24*s*, as shown in FIG. 7A, the pins 20, 22, 24 are positioned so as to be subjected to shear force from the cam base member 10 and the cam lobe member 12.

A fixation pin hole 12*j* of the cam lobe member 12 is designed so as to have such a size that the middle pin 22 of the three pins just fits. A pin hole 10*f* of the central body part 10*a* of the cam base member 10 has an axis-directional width that is longer than the axis-directional width of the pin 20. Furthermore, a pin hole 10*g* of the end body part 10*b* of the cam base member 10 is formed so as to have such a size that the pin 24 substantially just fits when a spring 24*a* is compressed.

As shown in FIG. 7A, when a hydraulic pressure equal to or greater than a predetermined value is not applied to the passages, each of the pins 20, 22, 24 is disposed so as to deviate from the corresponding pin hole by the bias force of the spring 24*s*. Thereby, the shear force is applied to the pins 22, 24, and the cam lobe member 12 is fixed at the second position. Therefore, it is possible to drive the rocker arm R by the main cam part 12*d* of the cam lobe member 12.

On the other hand, when the drive of the rocker arm by the cam lobe member 12 is stopped, the ECU performs such a control that the oil control valve CV is opened. Thereby, as shown by the arrows in FIG. 7B, a hydraulic pressure equal to or greater than the predetermined value is applied to the pin 20, through the oil passages T1, T2. Thereby, the spring 24*s* is compressed so that the pin 24 enters the pin hole 10*g* and the pin 22 enters the pin hole 12*j* of the cam lobe member 12, as shown in FIG. 7B. When the cam lobe member 12 becomes the state shown in FIG. 7B in this way, the cam lobe member 12 can move to the first position by the bias force of the spring 18, as described based on FIG. 5A to FIG. 6H. FIG. 7C schematically shows a state in which the cam lobe member 12 has departed from the second position to the first position side. While such a hydraulic pressure is applied, the cam lobe member 12 continues to oscillate between the first position and the second position. Here, as the result of the oscillation of the cam lobe member 12, the pin hole 12*j* departs from the spot along line VII-VII in FIG. 5A and deviates from the pin holes 10*f*, 10*g*, and therefore, the pin 22 does not appear in the cross-sectional view of FIG. 7C.

Then, once the hydraulic pressure is released (once the feed of the hydraulic pressure equal to or greater than the predetermined value is stopped), the cam lobe member 12 reaches the second position, and when the fixation pin hole 12*j* of the cam lobe member 12 is lined with the pin hole 10*f* and the pin hole 10*g*, the pins 20, 22, 24 are moved by the bias force of the spring 24*s*. Thereby, the cam lobe member 12 is maintained in the state of being fixed at the second position (see FIG. 7A).

Figure 8:
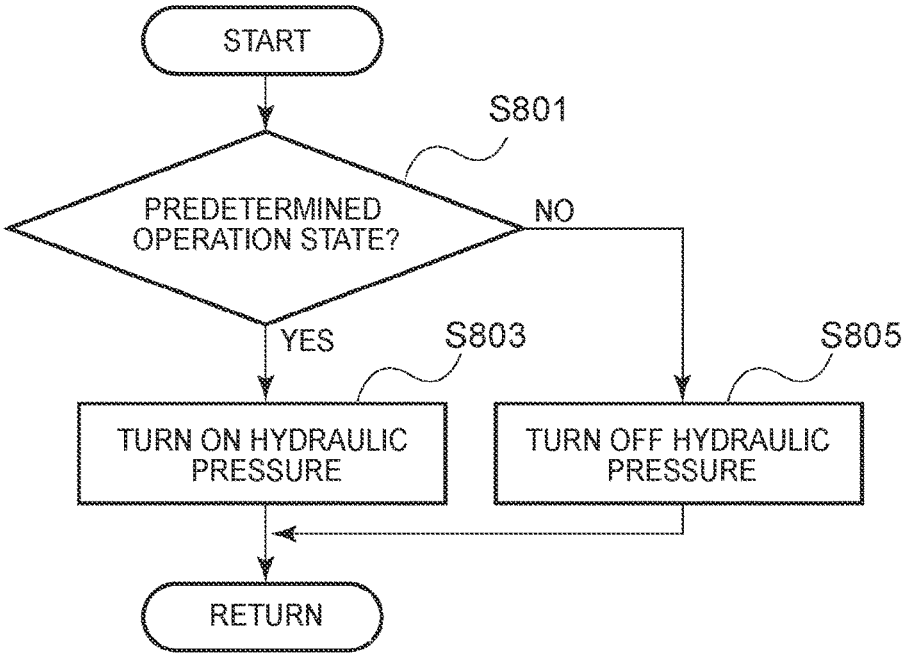
FIG. 8 is a flowchart for the control of the cam lobe member of the variable valve apparatus in FIG. 3.

The switching control for the oil control valve CV will be described based on a flowchart in FIG. 8. First, in step S801, whether the current operation state is a predetermined operation state is determined. Here, the ECU determines whether the current operation state is a predetermined operation state, by retrieving previously-set data or performing a predetermined computation based on the engine speed detected by the engine speed sensor 19*a* and the engine load detected by the engine load sensor 19*b*. The internal combustion engine in the embodiment is a four-cylinder engine, and can perform a cylinder cut operation in which two cylinders are suspended, in a predetermined operation state in which the engine load is low. In the internal combustion engine, the above variable valve apparatus is applied to cylinders for the cylinder cut operation. Therefore, the predetermined operation state is set to an operation state in which the cylinder cut operation is performed. However, in the present invention, the predetermined operation state may be another operation state. Here, as described above, the cylinder number and others of the internal combustion engine to which the invention is applied is not limited to the embodiment, and the cylinder cut operation in which two cylinders of the four-cylinder engine are suspended is just an example.

If the positive determination is made in step S801 because the current operation state is the predetermined operation state, the hydraulic pressure is turned on in step S803. That is, the ECU controls the opening of the oil control valve CV to a first predetermined opening position (for example, a full-opening position). Here, the first predetermined opening position, which may be fixed or may be variable, is set such that the above hydraulic pressure equal to or greater than the predetermined value is applied. Thereby, the fixation pins 20, 22, 24 of the cam unit CU become, for example, the state shown in FIG. 7B and FIG. 7C, and the opening of the valve V is stopped.

On the other hand, if the negative determination is made in step S801 because the current operation state is not the predetermined operation state, the hydraulic pressure is turned off in step S805. That is, the ECU controls the closing of the oil control valve CV to a second predetermined opening position (for example, a full-closing position). Here, the second predetermined opening position, which may be fixed or may be variable, is set such that the above hydraulic pressure equal to or greater than the predetermined value is not applied to the pin 20, particularly, such that the cam lobe member can return to the state shown in FIG. 7A. Thereby, the cam unit CU becomes the state shown in FIG. 7A, and the opening of the valve V is started.

Here, back to FIG. 6A to FIG. 6H, the motion of the cam lobe member 12 when the cam lobe member 12 is not fixed to the cam base member 10 will be further described. The camshaft S rotates in the direction by the arrows in FIG. 6A to FIG. 6H. When the support shaft 14 reaches the closest position to the rocker arm R (see FIG. 6B), the rocker arm R comes into contact with not only the outer surface (that is, the base circle part BC) of the cam base member 10 but also the cam lobe member 12. Thereby, the rocker arm R starts to push the concave curve part 12*f* of the push part 12*e* of the cam lobe member 12. Here, a valve spring VS is set so as not to be compressed and deformed by the bias force of the spring 18. Therefore, the cam lobe member 12 is pushed up in a direction from the first position toward the second position, and starts to rotate around the support shaft 14. Then, the contact spot of the rocker arm R with the cam lobe member 12 reaches the transition part 12*h* through the concave curve part 12*f*, and the cam lobe member 12 gets to be at the second position (see FIG. 6E). Furthermore, once the camshaft S rotates, the contact spot of the rocker arm R with the cam lobe member 12 moves along the convex curve part 12*g*. At this time, the cam lobe member 12 moves toward the first position relative to the cam base member 10, gradually and smoothly. Then, the cam lobe member 12 reaches the first position (see FIG. 6H), and the cam lobe member 12 does not contact with the rocker arm R, except a maximal lift spot (or a peak part) of the main cam part 12*d* (see FIG. 6A). Here, when the cam lobe member 12 is at the first position, the main cam part 12*d* does not need to contact with the rocker arm R.

Figure 6A:
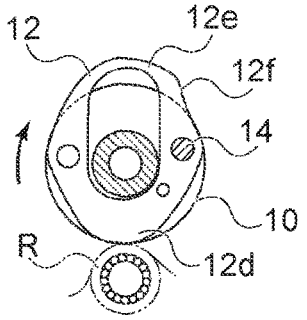
FIG. 6A to FIG. 6H are diagrams showing, in stages, the motion of the cam lobe member of the variable valve apparatus in FIG. 3.
Figure 6E:
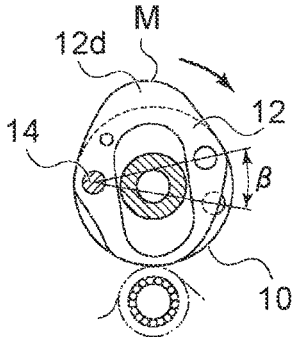
Figure 6B:
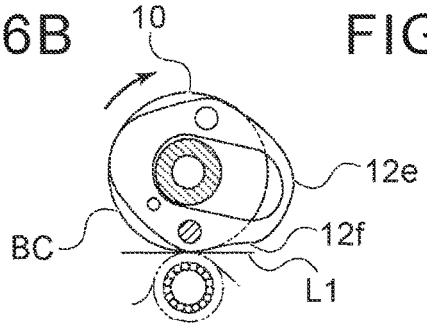
Figure 6F:
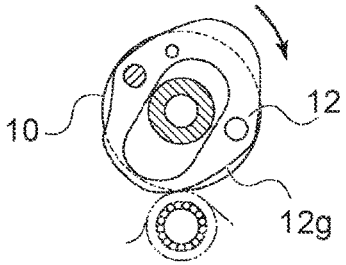
Figure 6C:
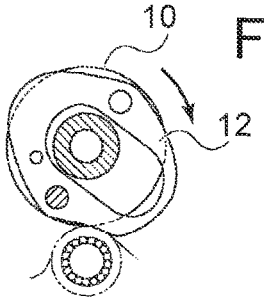
Figure 6G:
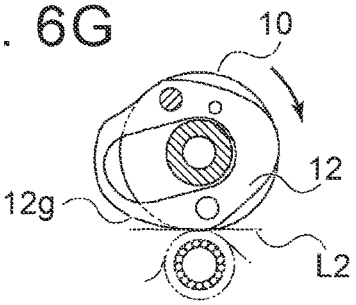
Figure 6D:
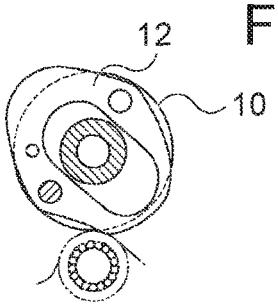
Figure 6H:
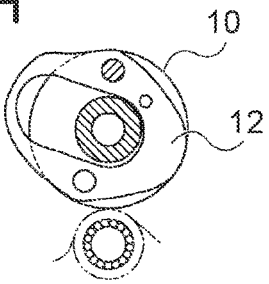

Here, focus is placed on FIG. 6B and FIG. 6G. It is understood that a tangential lime L1 at the contact spot of the cam lobe member 12 with the rocker arm R, in the state of FIG. 6B, is substantially a tangential line for the base circle part BC concurrently. Further, it is understood that a tangential line L2 at the contact spot of the cam lobe member 12 with the rocker arm R, in the state of FIG. 6G is substantially a tangential line for the base circle part BC concurrently. Therefore, when the cam lobe member 12 is not fixed to the cam base member 10, it is possible to smoothly start the contact of the rocker arm R with the cam lobe member 12, in association with a rotation of the camshaft S. Then, it is possible to smoothly finish the contact of the rocker arm R with the cam lobe member 12, in association with a further ration of the camshaft S.

Furthermore, the concave shape of the concave curve part 12*f* is recessed in a concave shape, in the radial direction, compared to the parts on the circumferential side surface at both sides of a maximal lift spot M of the main cam part 12*d*. Therefore, the concave curve part 12*f* can securely contact with the rocker arm R and can continue to be sufficiently forced by the rocker arm. Further, the convex shape of the convex curve part 12*g* swells in a convex shape, in the radial direction, compared to the parts on the circumferential side surface at both sides of the maximal lift spot M of the main cam part 12*d*. Therefore, in the process from the state of FIG. 6F to the state of FIG. 6G the convex curve part 12*g* can securely contact with the rocker arm R and can continue to be sufficiently forced by the rocker arm. Since the push part 12*e* is formed in this way, it is possible to inhibit the cam lobe member 12 from drastically moving (for example, departing) from the contact state with the rocker arm R, and to prevent the occurrence of the collision between the respective members, and the like.

Figure 2B:
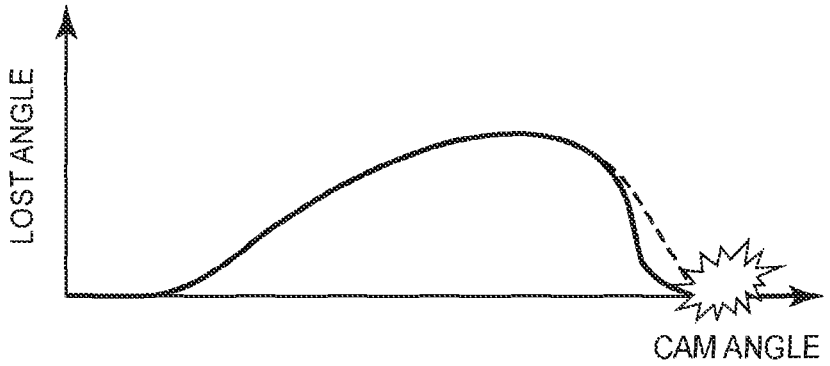
FIG. 2B RELATED ART
FIG. 2B is a graph for describing a motion of the related cam lobe member.
Figure 9:
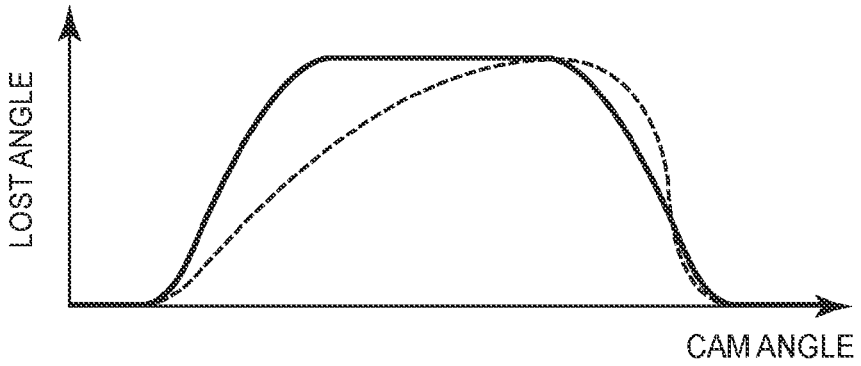
FIG. 9 is a conceptual diagram for describing an effect of the variable valve apparatus in FIG. 3.

Here, the motion of the cam lobe member 12 in the first embodiment will be compared with the motion of the related cam lobe member 102. In the embodiment, a lost angle β is defined as the rotation angle of the pin hole 12*j* around the support shaft, on the basis of the position of the pin hole 12*j* relative to the support shaft 14 in the state of FIG. 6A (see the dotted line circle in FIG. 6E). Therefore, the lost angle β is zero when the position of the cam lobe member 12 is at the first position as shown in FIG. 6A, and increases toward the second position. FIG. 6E shows an example of the lost angle (3, and this angle is the maximum value. FIG. 9 shows a curve (solid line) for the lost angle β and a curve (dotted line) for the lost angle α, for comparing the change in the lost angle β with the ideal change in the lost angle α of FIG. 2B in the related art. As understood from FIG. 9, the motion of the cam lobe member 12 in the first embodiment is smoother than the motion of the cam lobe member in the related art. Therefore, according to the first embodiment of the invention, it is possible to prevent a drastic motion of the cam lobe part relative to the cam base part more suitably. Such a motion of the cam lobe member 12 is actualized because the push part 12*e* is provided at a different spot from the main cam part 12*d*. The push part 12*e* of the cam lobe member 12 is designed corresponding to an intended smooth motion.

Figure 10B:
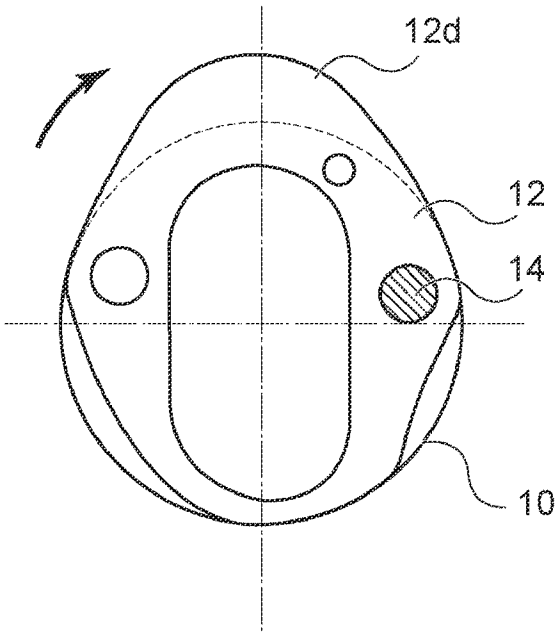
Figure 10A:
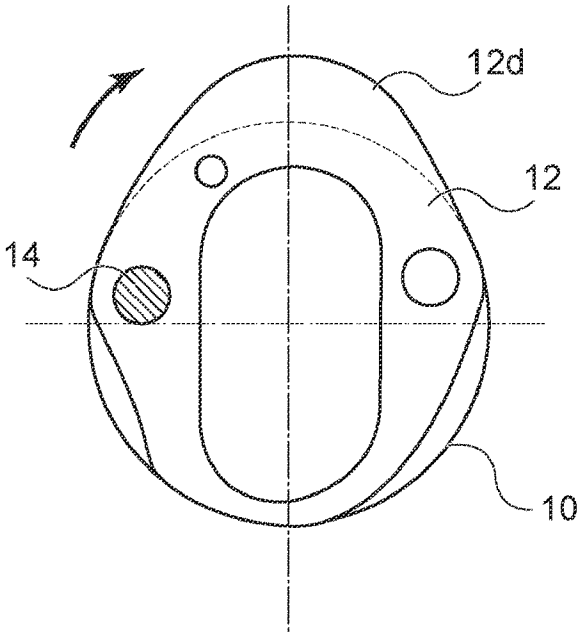

Thus, the first embodiment has been described, but various alterations are possible. First, in the above first embodiment, as shown in FIG. 10A, the support shaft 14 is disposed at a connection part that is of the two connection parts between the main cam part and the push part and that is on the closing side of the main cam part of the cam lobe member. However, as shown in FIG. 10B, the support shaft 14 may be disposed at a connection part on the opening side of the main cam part of the cam lobe member. However, preferably, the support shaft 14 should be disposed at the connection part on the closing side of the main cam part 12*d* of the cam lobe member, as shown in FIG. 10A, that is, as shown in the above first embodiment. By the disposition of the support shaft 14 in FIG. 10A, it is possible to make gentler the motion of the cam lobe member 12 relative to the cam base member 10 right before the cam lobe member 12 reaches the first position, compared to the disposition of the support shaft 14 in FIG. 10B. Therefore, as described above, it is possible to prevent the collision of the stopper pin 12*c* more suitably.

Figure 11A:
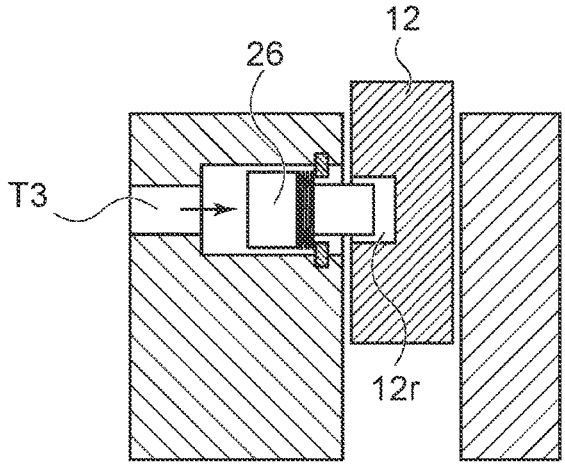
FIG. 11A to FIG. 11C are each schematic views showing a modification of the fixation mechanism in FIG. 7A to FIG. 7C.
Figure 11B:
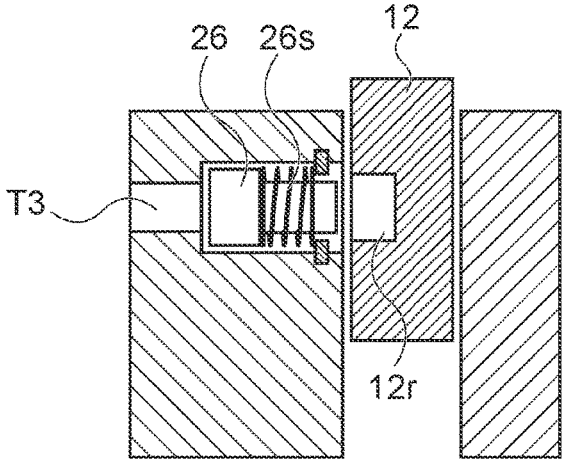
Figure 11C:
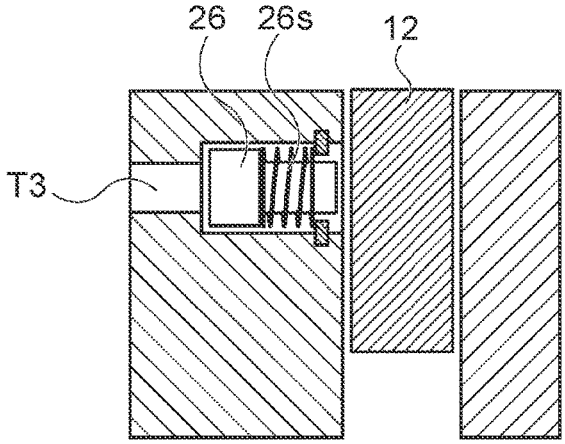

Furthermore, in the first embodiment, the pin hole 12*j* is provided on the cam lobe member 12, and for selectively positioning the fixation pin 22 relative to the pin hole, the two other pins are used. However, the number of pins can be arbitrarily set to one or more number. FIG. 11A to FIG. 11C show a modification of the fixation mechanism. The fixation mechanism in FIG. 11A to FIG. 11C includes a pin member 26 that is biased to the side of an oil passage T3 by a spring 26*s*, and a pin engagement hole 12*r* is provided on the cam lobe member 12. FIG. 11A shows a state in which hydraulic pressure is applied as shown by the arrow (unlike the above first embodiment) and the pin member 26 is engaged with the hole 12*r* of the cam lobe member so that the cam lobe member is fixed at the second position. FIG. 11B shows a state in which the hydraulic pressure is released and the pin member 26 is removed from the pin engagement hole 12*r*. FIG. 11C shows a state in which the cam lobe member 12 has moved from the second position to the first position side by oscillation. Thus, in the example in FIG. 11A to FIG. 11C, the hydraulic pressure is released in the above step S803, and the hydraulic pressure is applied in step S805. Here, in the state of FIG. 11C, as the result of the oscillation of the cam lobe member 12, the hole 12*r* has moved from the position allowing for the engagement with the pin member 26. Therefore, the hole 12*r* of the cam lobe member 12 does not appear in the cross-sectional view of FIG. 11C.

Figure 12A:
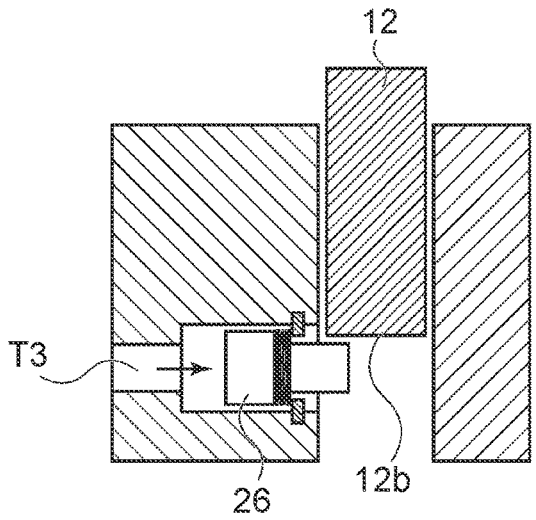
FIG. 12A to FIG. 12C are each schematic views showing a further modification of the fixation mechanism in FIG. 7A to FIG. 7C.
Figure 12B:
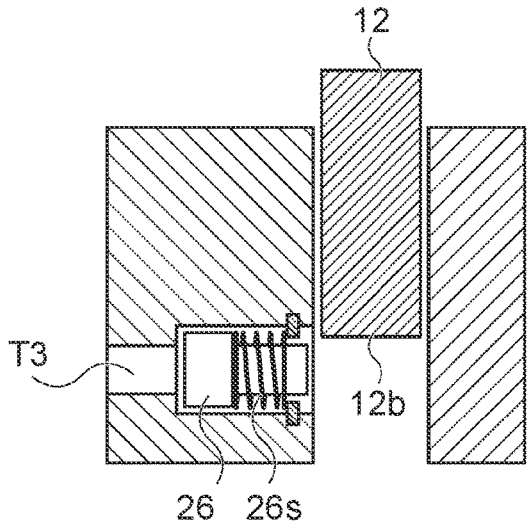
Figure 12C:
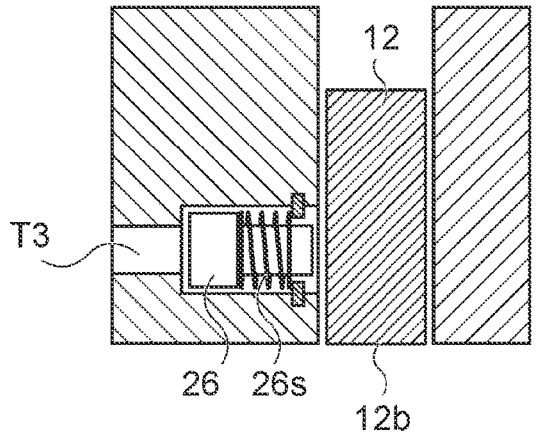

FIG. 12A to FIG. 12C show a further modification of the fixation mechanism. The fixation mechanism in FIG. 12A to 12C is configured such that the pin engagement hole is not specially provided on the cam lobe member 12 and the pin member 26 supports the cam lobe member 12 at a wall part that forms the hole 12*b* originally provided on the cam lobe member 12. The drive of the pin member 26, that is, the hydraulic control has been described based on FIG. 11A to FIG. 11C. FIG. 12A shows a state in which the pin member is pushed by hydraulic pressure as shown by the arrow and the pin member reaches a position where the pin member is engaged with the cam lobe member so that the cam lobe member is fixed at the second position. FIG. 12B shows a state in which the hydraulic pressure is released so that the pin member and the cam lobe member are disengaged. FIG. 12C shows a state in which the cam lobe member has moved from the second position to the first position side by oscillation.

Figure 13A:
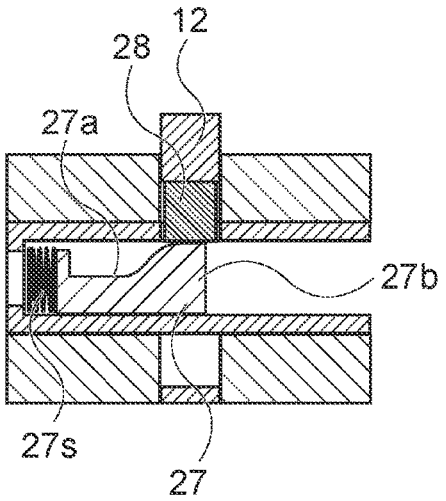
Figure 13B:
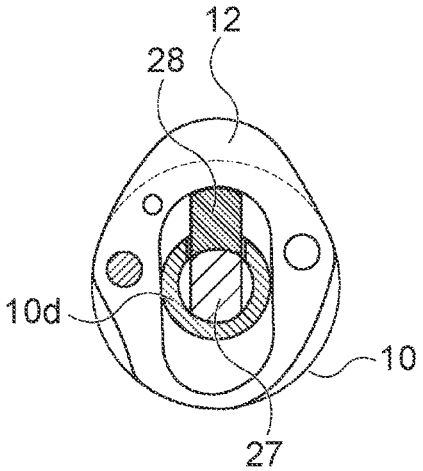
Figure 13C:
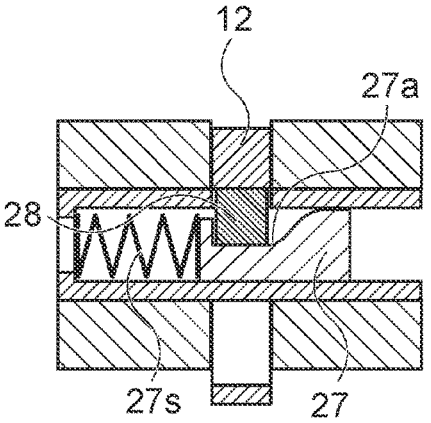
Figure 13D:
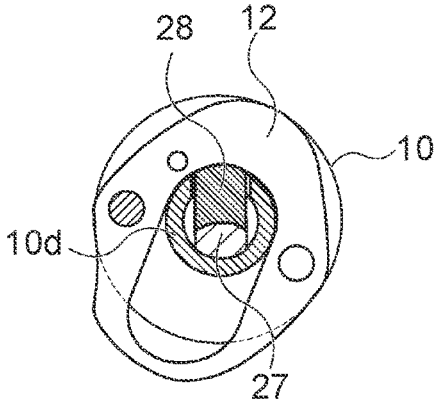

FIG. 13A to FIG. 13D show a further modification of the fixation mechanism. The fixation mechanism in FIG. 13A to FIG. 13D is configured such that a support member 27 is provided in the oil passage of the inner axis part 10*d*, the support position of a stopper member 28 is changed by the drive of the support member 27 in the axis direction, and thereby, the cam lobe member 12 is held. Although not illustrated, the stopper member 28 is engaged so as to be capable of sliding on a surface of the support member 27. The support member 27 moves in the axis direction, and thereby, the stopper member 28 can move in the radial direction. The support member 27 includes a receiving concave part 27*a* and a bump part 27*b*. FIG. 13A and FIG. 13B show a state in which the support member 27 is pushed to the support position by the hydraulic pressure shown by the arrow and thereby the stopper member 28 is pushed up outward in the radial direction by the bump part 27*b* of the support member 27 so that the cam lobe member 12 is held and fixed at the second position. FIG. 13C and FIG. 13D show a state in which, since the hydraulic pressure equal to or greater than a predetermined value is not applied, the support member 27 is at a non-support position due to the bias by a spring 27*s* and the stopper member 28 is positioned on the receiving concave part 27*a* so that the cam lobe member 12 is at the first position by the bias force of the spring 18. Here, FIG. 13A and FIG. 13C are each diagrams of a cross section parallel to the axis line of the camshaft, and FIG. 13B and FIG. 13D are each diagrams of a radial-directional cross section perpendicular to the axis line of the camshaft.

Further, in the above embodiment, the springs 18 for biasing the cam lobe members to the first position are disposed in the concave part between the two cam lobe members. However, the springs 18 may be disposed at other spots. The springs 18 may be disposed on the axis-directional end part sides of the cam unit, relative to the cam lobe members 12. Further, the springs may be disposed in the interior of the cam unit. Furthermore, as the springs 18, which are elastic members (bias members), various types of springs such as torsion springs and coil springs may be used.

Next, a second embodiment of the invention will be described. In the embodiment, the variable valve apparatus in the invention is applied to each of the intake valve and the exhaust valve. Hereinafter, only characteristic configurations of the second embodiment will be described. For constituent elements corresponding to the already-described constituent elements, the same reference characters are assigned, and the repetitive descriptions are omitted.

Figure 14A:
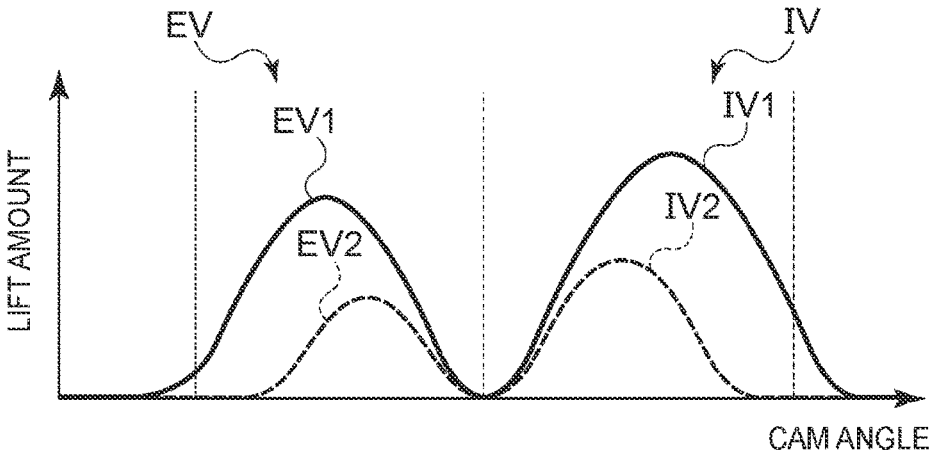

In the above first embodiment, the cam base member 10 has an outer surface whose shape is the shape of the base circle part BC, and the lift amount of the valve by the cam base member 10 is zero. However, the cam base member may have an outer surface corresponding to a lift amount (first lift amount) that is smaller than the lift amount (second lift amount) by the cam lobe member 12 but that is not zero, and the second embodiment has a cam base member configured to actualize this. FIG. 14A is a graph showing a lift curve EV of the exhaust valve and a lift curve IV of the intake valve along an identical time axis. Here, the lift curve EV of the exhaust valve and the lift curve IV of the intake valve may overlap partially, but need not overlap.

Figure 14B:
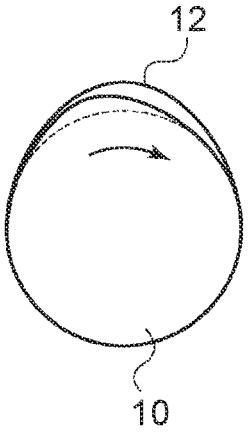

FIG. 14A shows two lift curves EV1, EV2 of the exhaust valve. The lift curve EV1 shown by the solid line is a lift curve when the rocker arm is driven by the cam lobe member, and the lift curve EV2 shown by the broken line is a lift curve when the rocker arm is driven by the outer surface of the cam base member. FIG. 14B shows the relation between the cam base member and cam lobe member of a cam unit for the exhaust valve that has a configuration corresponding to the lift curves. In FIG. 14B, the reference base circle is shown by the broken line, and the cam base member 10 has a shape corresponding to the lift curve EV2, which is relatively small. The cam lobe member 12 is shown such that the main cam part 12*d* protrudes from the cam base member 10. That is, in FIG. 14B, the cam lobe member is at the second position.

Figure 14C:
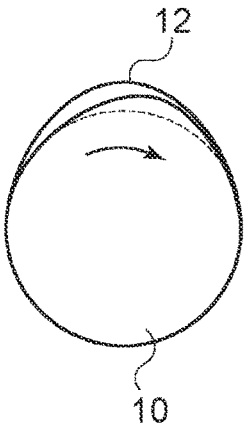

Further, FIG. 14A shows two lift curves IV1, IV2 of the intake valve. The lift curve IV1 shown by the solid line is a lift curve by the cam lobe member, and the lift curve IV2 shown by the broken line is a lift curve by the outer surface of the cam base member. FIG. 14C shows the relation between the cam base member and cam lobe member of a cam unit for the intake valve that has a configuration corresponding to the lift curves. In FIG. 14C, the reference base circle is shown by the broken line, and the cam base member 10 has a shape corresponding to the lift curve IV2, which is relatively small. The cam lobe member 12 is disposed such that the main cam part partially protrudes from the cam base member 10. That is, in FIG. 14C, the cam lobe member is at the second position.

As shown in FIG. 14A, the two lift curves EV1, EV2 of the exhaust valve overlap (or coincide) on the closing side. Therefore, when the cam lobe member is at the second position, the closing-side part of the main cam part 12*d* of the cam lobe member 12 coincides with the outer surface of the cam base member 10, as viewed from the axis direction of the camshaft S (see FIG. 14B). Similarly, as shown in FIG. 14A, the two curves IV1, IV2 of the intake valve overlap (or coincide) on the opening side, and the opening-side part of the main cam part 12*d* of the cam lobe member 12 at the second position coincides with the outer surface of the cam base member, as viewed from the axis direction of the camshaft S (see FIG. 14C).

Figure 15B:
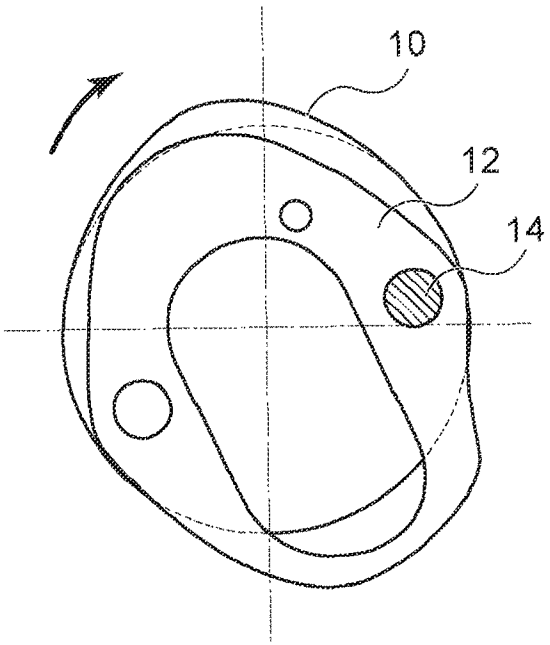
Figure 15A:
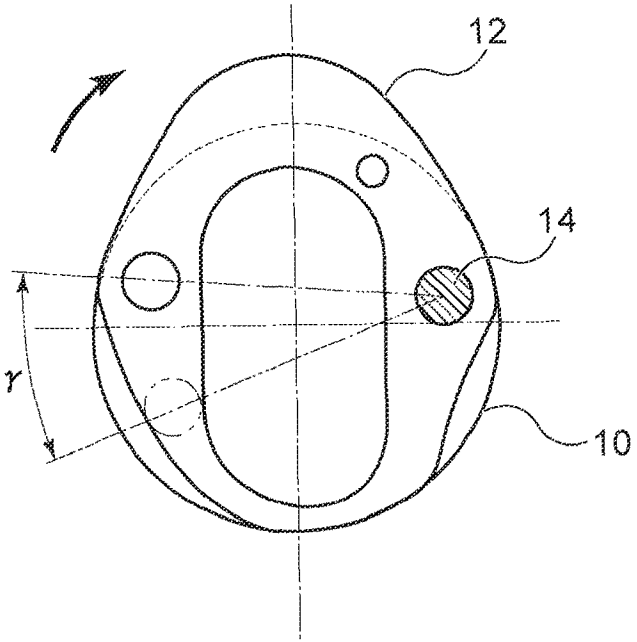

Here, FIG. 15A and FIG. 15B show the relation between the cam base member 10 and cam lobe member 12 of the cam unit for the exhaust valve. FIG. 15A shows a state in which the cam lobe member is at the second position relative to the cam base member, and FIG. 15B shows a state in which the cam lobe member is at the first position relative to the cam base member. As shown in FIG. 15A and FIG. 15B, there are two spots in the circumferential direction as the connection part between the main cam part 12*d* and push part 12*e* of the cam lobe member 12, that is, there are a connection part on the opening side of the main cam part 12*d* and a connection part on the closing side of the main cam part 12*d*. Of the connection parts, at the connection part on the opening side, the support shaft 14 is disposed. Here, the arrows in FIG. 15A and FIG. 15B show the rotation direction of the camshaft.

Figure 16B:
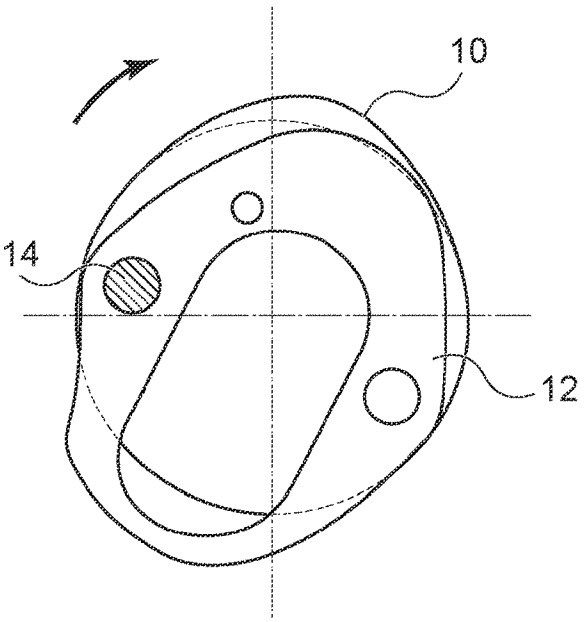
Figure 16A:
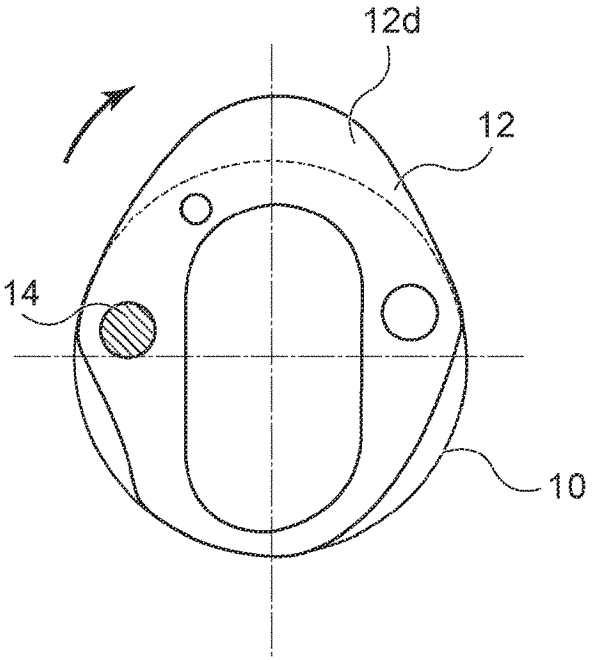

On the other hand, FIG. 16A and FIG. 16B show the relation between the cam base member 10 and cam lobe member 12 of the cam unit for the intake valve. FIG. 16A shows a state in which the cam lobe member 12 is at the second position relative to the cam base member 10, and FIG. 16B shows a state in which the cam lobe member is at the first position relative to the cam base member. As shown in FIG. 16A and FIG. 16B, the support shaft 14 is disposed at the connection part on the closing side of the main cam part 12*d*. Here, the arrows in FIG. 16A and FIG. 16B show the rotation direction of the camshaft.

Thus, as for the exhaust valve, the lift curve by the cam lobe member 12 and the lift curve by the cam base member 10 overlap on the closing side, and the support shaft 14 is disposed at the connection part on the opening side of the main cam part 12*d* of the cam lobe member. On the other hand, as for the intake valve, the lift curve by the cam lobe member 12 and the lift curve by the cam base member 10 overlap on the opening side, and the support shaft 14 is disposed at the connection part on the closing side of the main cam part of the cam base member. The arrangement position of the support shaft 14 is set selectively to the side on which the oscillation angle (corresponding to the above lost angle β) of the cam lobe member 12 around the support shaft 14 between the first position and the second position is relatively smaller (see an angle γ in FIG. 15A <an angle δ in FIG. 17A) (thereby, the range of the reciprocating motion of the cam lobe member 12 relative to the cam base member 10 becomes relatively smaller). Therefore, even in an operation region in which the engine speed is higher, it is possible to switch the lift amount of each valve more suitably.

Figure 17B:
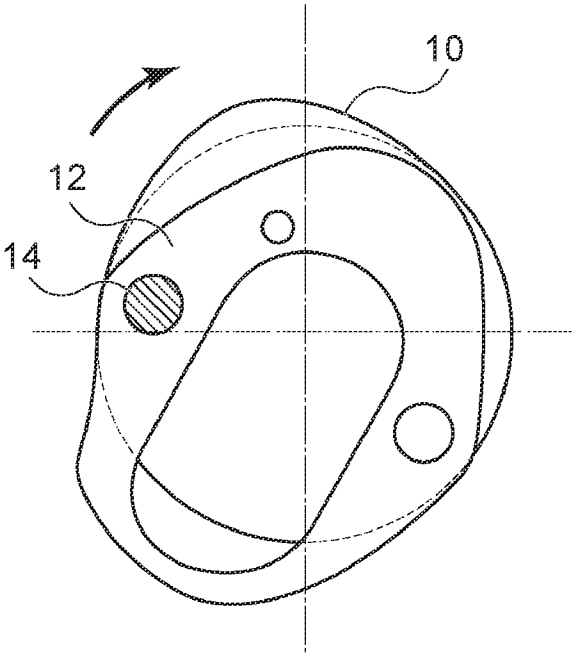
Figure 17A:
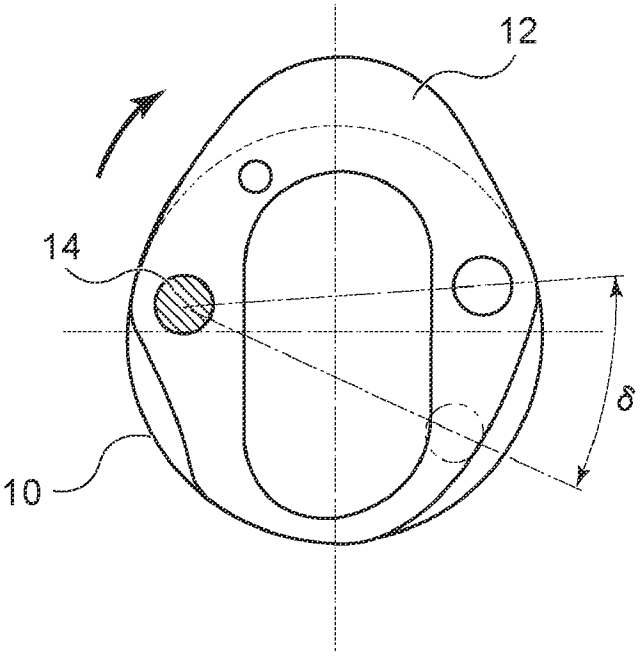
Figure 18B:
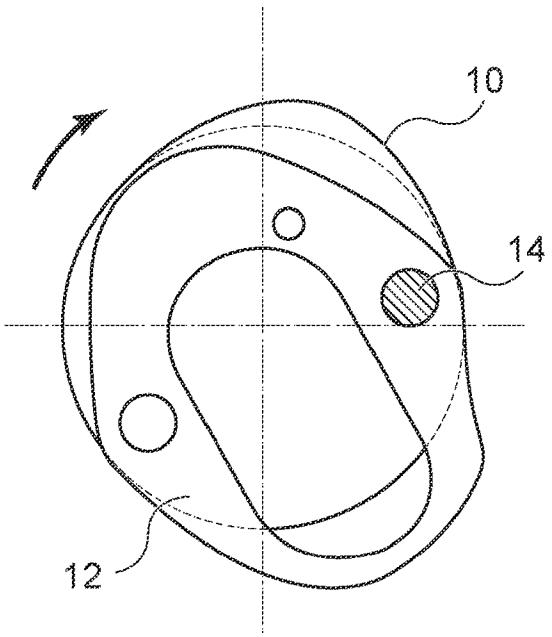
Figure 18A:
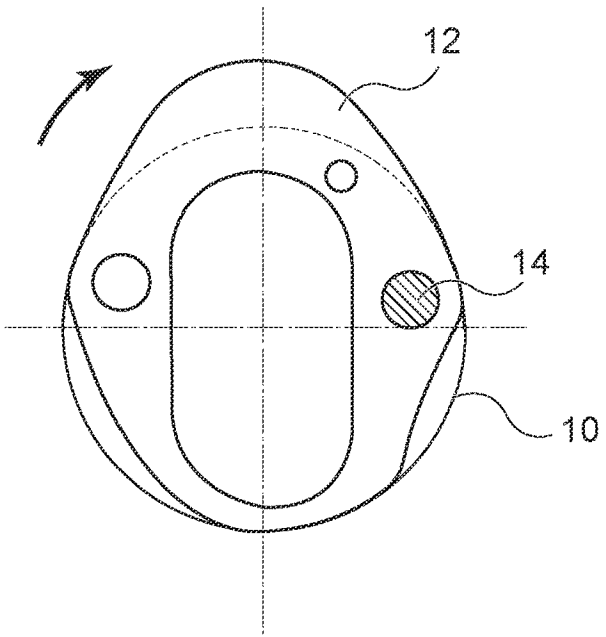

However, as shown in FIG. 17A and FIG. 17B (FIG. 17A and FIG. 17B correspond to FIG. 15A and FIG. 15B, respectively), in the cam unit for the exhaust valve, the support shaft 14 may be configured to be disposed at the connection part on the closing side of the main cam part 12*d* of the cam lobe member. Further, as shown in FIG. 18A and FIG. 18B (FIG. 18A and FIG. 18B correspond to FIG. 16A and FIG. 16B, respectively), in the cam unit for the intake valve, the support shaft may be configured to be disposed at the connection part on the opening side of the main cam part of the cam lobe member.

Next, a third embodiment of the invention will be described. The variable valve apparatus in the third embodiment is configured such that the cam lobe member 12 performs the reciprocating motion linearly relative to the cam base member 10. Hereinafter, only characteristic configurations of the embodiment will be described. For constituent elements corresponding to the already-described constituent elements, the same reference characters are assigned, and the repetitive descriptions are omitted.

Figure 19A:
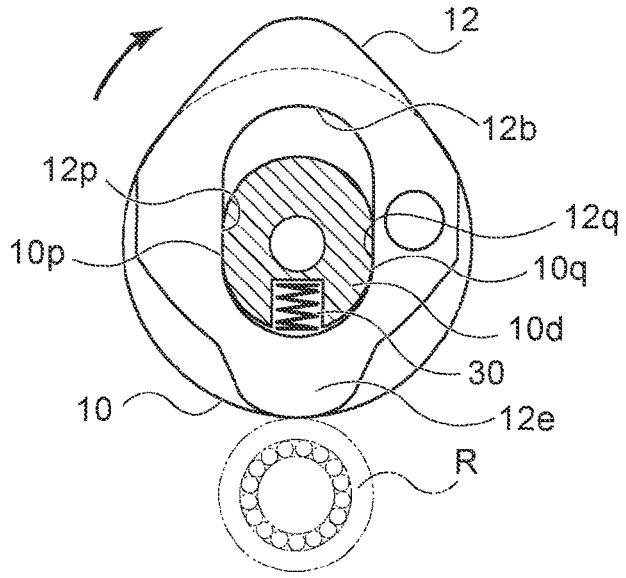
Figure 19B:
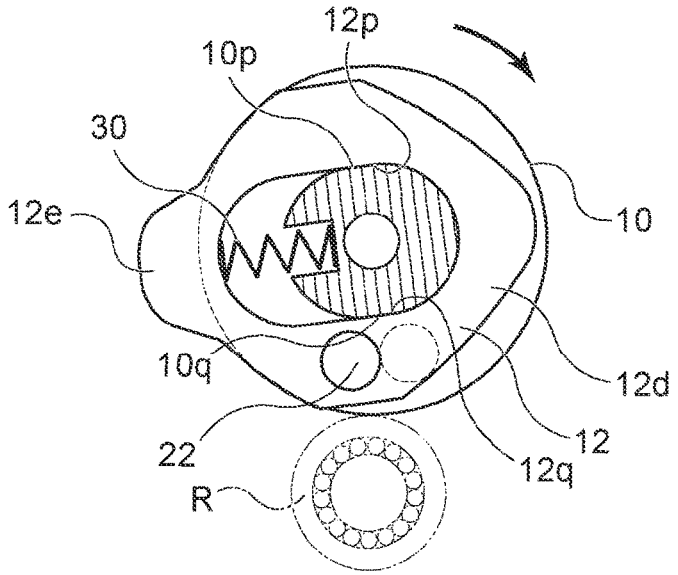

FIG. 19A and FIG. 19B show a principal part of a variable valve apparatus in the third embodiment. FIG. 19A shows a state in which the cam lobe member 12 is at the second position, and FIG. 19B shows a state in which the cam lobe member 12 is at the first position. The cam lobe member 12 includes the main cam part 12*d* and the push part 12*e*. The push part 12*e* is formed so as to have reflective symmetry in FIG. 19A and in FIG. 19B (that is, on a surface that is orthogonal to the axis direction of the camshaft), and is formed such that the cam lobe member 12 smoothly starts to contact with the rocker arm R or departs from the rocker arm R in each stage of the early push stage and later push stage for the cam lobe member 12.

The cam lobe member 12 includes a spring 30 between the outer surface of the inner axis part 10*d* and the wall surface forming the hole 12*b* of the cam lobe member 12. The spring 30 is configured to bias the cam lobe member 12 toward the first position.

When the cam lobe member is not fixed at the second position by the fixation mechanism (this is the same as that in the first embodiment) with the pin, the cam lobe member 12 performs the reciprocating motion linearly relative to the cam base member 10 between the first position and the second position, by the rotation of the camshaft S.

The inner axis part 10*d* includes flat side surfaces 10*p*, 10*q* that face each other. On the other hand, the cam lobe member 12 includes, on the wall surface of the hole 12*b*, inner surfaces 12*p*, 12*q* that can slide along the side surfaces 10*p*, 10*q*. Furthermore, the range in which the cam lobe member 12 can move is restricted within the range of the size of the hole 12*b* of the cam lobe member 12. Therefore, in the third embodiment, the hole 12*b* and the inner axis part 10*d* constitute a restriction mechanism.

Embodiments of the invention are not limited to only the above-described embodiments, and the invention includes all modifications, applications and equivalents that are comprehended in the idea of the invention specified by the claims. Therefore, the invention should not be limitedly interpreted, and can be applied to other arbitrary technologies that belong to the range of the idea of the invention.

What is claimed is:

1. A variable valve apparatus for an internal combustion engine that is capable of varying lift amount of an engine valve, the variable valve apparatus comprising:

a cam base member provided on a camshaft and including a first portion and a second portion connected by an axially extending fixation shaft, the cam base member being configured to rotate in accordance with rotation of the camshaft;

a cam lobe member disposed between the first portion and the second portion of the cam base member, the cam lobe being an annular shape having a hole through which the fixation shaft is inserted, and including a main cam part and a push part, the cam lobe member provided so as to be movable relative to the cam base member between a first position where the main cam part is in a state of not protruding relative to the cam base member and the push part is in a state of protruding relative to the cam base member and a second position where the main cam part is in a state of protruding relative to the cam base member and the push part is in a state of not protruding relative to the cam base member, the push part being at a different position from the main cam part;

an elastic member provided between the cam base member and the cam lobe member, the elastic member configured to bias the cam lobe member toward the first position; and a fixation mechanism configured to fix the cam lobe member to the cam base member when the cam lobe member is at the second position.

2. The variable valve apparatus according to claim 1, further comprising a restriction mechanism configured to restrict a movement range of the cam lobe member relative to the cam base member.

3. The variable valve apparatus according to claim 1, wherein the cam lobe member is configured to move around a fulcrum member relative to the cam base member.

4. The variable valve apparatus according to claim 3, wherein the fulcrum member is provided at any one of two connection parts that connect the main cam part and the push part of the cam lobe member and that are apart in a circumferential direction.

5. The variable valve apparatus according to claim 4, wherein the push part of the cam lobe member includes a concave curve part on the fulcrum member side, and a convex curve part apart from the concave curve part.

6. The variable valve apparatus according to claim 4, wherein an outer circumferential surface of the cam base member has a shape of a reference base circle, and the fulcrum member is disposed at a connection part that is of the two connection parts and that is on a closing side of the main cam part of the cam lobe member.

7. The variable valve apparatus according to claim 4, wherein when a first lift curve of the engine valve and a second lift curve of the engine valve overlap on a closing side or an opening side, an arrangement position of the fulcrum member is set to one connection part that is of the two connection parts and that makes an oscillation angle relatively smaller, the first lift curve being a lift curve when the cam lobe member is not fixed at the second position, the second lift curve being a lift curve when the cam lobe member is fixed at the second position, the oscillation angle being an oscillation angle of the cam lobe member around the fulcrum member between the first position and the second position.

8. The variable valve apparatus according to claim 1, wherein the cam lobe member is configured to perform reciprocating motion linearly relative to the cam base member.

9. The variable valve apparatus according to claim 8, wherein the push part of the cam lobe member has reflective symmetry on a surface that is orthogonal to an axis direction of the camshaft.

* * * * *